US008085521B2

(12) United States Patent
Chian

(10) Patent No.: US 8,085,521 B2
(45) Date of Patent: Dec. 27, 2011

(54) FLAME ROD DRIVE SIGNAL GENERATOR AND SYSTEM

(75) Inventor: Brent Chian, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 1210 days.

(21) Appl. No.: 11/773,198

(22) Filed: Jul. 3, 2007

(65) Prior Publication Data

US 2009/0009344 A1 Jan. 8, 2009

(51) Int. Cl.
*F23Q 3/00* (2006.01)

(52) U.S. Cl. ..... 361/253

(58) Field of Classification Search ..... 361/253
See application file for complete search history.

(56) References Cited

U.S. PATENT DOCUMENTS

| | | | |
|---|---|---|---|
| 3,425,780 | A | 2/1969 | Potts |
| 3,520,645 | A | 7/1970 | Cotton et al. |
| 3,649,156 | A | 3/1972 | Conner |
| 3,681,001 | A | 8/1972 | Potts |
| 3,836,857 | A | 9/1974 | Ikegami et al. |
| 3,909,816 | A | 9/1975 | Teeters |
| 4,157,506 | A | 6/1979 | Spencer |
| 4,221,557 | A | 9/1980 | Jalics |
| 4,242,079 | A | 12/1980 | Matthews |
| 4,269,589 | A | 5/1981 | Matthews |
| 4,280,184 | A | 7/1981 | Weiner et al. |
| 4,303,385 | A | 12/1981 | Rudich, Jr. et al. |
| 4,370,557 | A | 1/1983 | Axmark et al. |
| 4,450,499 | A | 5/1984 | Sorelle |
| 4,457,692 | A | 7/1984 | Erdman |
| 4,483,672 | A | 11/1984 | Wallace et al. |

(Continued)

FOREIGN PATENT DOCUMENTS

EP 0967440 12/1999

(Continued)

OTHER PUBLICATIONS www.playhookey.com, "Series LC Circuits," 5 pages, printed Jun. 15, 2007.

(Continued)

*Primary Examiner* — Stephen W Jackson
(74) *Attorney, Agent, or Firm* — Seager, Tufte & Wickhem LLC

(57) ABSTRACT

A flame rod drive signal generator and system for producing a flame rod drive signal for a flame rod of a combustion system. In one illustrative embodiment, the flame rod drive signal generator may include a voltage source, an input signal having a frequency, an LC oscillator and a drive mechanism. The drive mechanism may be powered by the voltage source, and may have an output coupled to the LC oscillator. The drive mechanism may receive the input signal, and produces a current in the LC oscillator that has a frequency that is related to the frequency of the input signal. The LC oscillator may then provide a flame rod drive signal to a flame rod that has an amplitude that is larger than the amplitude of the voltage source. In some cases, a controller may monitor the amplitude of the flame rod drive signal and adjust the frequency, duty cycle, or both, of the input signal to achieve a desired amplitude of the flame rod drive signal. Alternatively, or in addition, the controller may monitor an ionization current produced by the flame rod when the flame rod is subject to a flame.

20 Claims, 7 Drawing Sheets

U.S. PATENT DOCUMENTS 4,521,825 A 6/1985 Crawford
4,527,247 A 7/1985 Kaiser et al.
4,555,800 A 11/1985 Nishikawa et al.
4,655,705 A 4/1987 Shute et al.
4,672,324 A 6/1987 Van Kampen
4,695,246 A 9/1987 Beilfuss et al.
4,709,155 A 11/1987 Yamaguchi et al.
4,777,607 A 10/1988 Maury et al.
4,830,601 A 5/1989 Dahlander et al.
4,842,510 A 6/1989 Grunden et al.
4,843,084 A 6/1989 Parker et al.
4,872,828 A 10/1989 Mierzwinski
4,904,986 A 2/1990 Pinckaers
4,949,355 A 8/1990 Dyke et al.
4,955,806 A 9/1990 Grunden et al.
5,026,270 A 6/1991 Adams et al.
5,026,272 A 6/1991 Takahashi et al.
5,037,291 A 8/1991 Clark
5,073,769 A 12/1991 Kompelien
5,077,550 A 12/1991 Cormier
5,112,217 A 5/1992 Ripka et al.
5,126,721 A 6/1992 Butcher et al.
5,158,477 A 10/1992 Geary
5,175,439 A 12/1992 Harer et al.
5,222,888 A 6/1993 Jones et al.
5,236,328 A 8/1993 Tate et al.
5,255,179 A 10/1993 Zekan et al.
5,276,630 A 1/1994 Baldwin et al.
5,280,802 A 1/1994 Comuzie, Jr.
5,300,836 A 4/1994 Cha
5,347,982 A 9/1994 Binzer et al.
5,365,223 A 11/1994 Sigafus
5,391,074 A 2/1995 Meeker
5,424,554 A 6/1995 Marran et al.
5,446,677 A 8/1995 Jensen et al.
5,472,336 A 12/1995 Adams et al.
5,506,569 A 4/1996 Rowlette
5,567,143 A 10/1996 Servidio
5,599,180 A 2/1997 Peters et al.
5,682,329 A 10/1997 Seem et al.
5,722,823 A 3/1998 Hodgkiss
5,797,358 A 8/1998 Brandt et al.
5,971,745 A 10/1999 Bassett et al.
6,060,719 A 5/2000 DiTucci et al.
6,071,114 A 6/2000 Cusack et al.
6,084,518 A 7/2000 Jamieson
6,222,719 B1 4/2001 Kadah
6,261,086 B1 7/2001 Fu
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl, Jr.
6,474,979 B1 11/2002 Rippelmeyer
6,486,486 B1 11/2002 Haupenthal
6,509,838 B1 1/2003 Payne et al.
6,552,865 B2 4/2003 Cyrusian
6,676,404 B2 1/2004 Lochschmied
6,743,010 B2 6/2004 Bridgeman et al.
6,782,345 B1 8/2004 Siegel et al.
6,794,771 B2 9/2004 Orloff
6,912,671 B2 6/2005 Christensen et al.
6,917,888 B2 7/2005 Logvinov et al.
7,088,137 B2 8/2006 Behrendt et al.
7,088,253 B2 8/2006 Grow
7,202,794 B2 4/2007 Huseynov et al.
7,241,135 B2 7/2007 Munsterhuis et al.
7,255,285 B2 8/2007 Troost et al.
7,274,973 B2 9/2007 Nichols et al.
7,289,032 B2 10/2007 Seguin et al.
7,327,269 B2 2/2008 Kiarostami
7,617,691 B2 11/2009 Street et al.
7,728,736 B2 6/2010 Leeland et al.
7,764,182 B2 7/2010 Chian et al.
7,768,410 B2 * 8/2010 Chian ..... 340/577
7,800,508 B2 9/2010 Chian et al.
2002/0099474 A1 7/2002 Khesin
2003/0064335 A1 4/2003 Canon
2003/0222982 A1 12/2003 Hamdan et al.
2004/0209209 A1 10/2004 Chodacki et al.
2005/0086341 A1 4/2005 Enga et al.
2006/0257805 A1 11/2006 Nordberg et al.
2007/0159978 A1 7/2007 Anglin et al.
2007/0188971 A1 8/2007 Chian et al.
2009/0136883 A1 5/2009 Chian et al.
2010/0013644 A1 1/2010 McDonald et al.
2010/0265075 A1 10/2010 Chian

FOREIGN PATENT DOCUMENTS

EP 1148298 10/2001
WO 9718417 5/1997

OTHER PUBLICATIONS

Honeywell, "S4965 SERIES Combined Valve and Boiler Control Systems," 16 pages, prior to the filing date of present application.
Honeywell, "SV9410/SV9420; SV9510/SV9520; SV9610/SV9620 SmartValve System Controls," Installation Instructions, 16 pages, 2003.

* cited by examiner

FLAME ROD DRIVE SIGNAL GENERATOR AND SYSTEM

FIELD

The present invention relates generally to flame sensing circuits, and more particularly, to flame rod drive signal generators and systems.

BACKGROUND

Commercial and residential buildings and structures can include many building system components. In some cases, the building components may be gas-fired building components such as furnaces, boilers, water heaters, deep fryers, as well as many other types of gas-fired building components. Gas-fired building components often include a combustion system acting as the heating system for the component. One example combustion system may include a gas source, a gas valve to regulate the gas source, a burner, an ignition system to ignite the burner when desired, and a controller to control the operation of the combustion system.

In some combustion systems, a flame rod may be provided to sense the presence of the flame, indicating that the gas burner is ignited. In this case, the presence of the flame may be detected by an ionization current in the flame rod. To detect the ionization current, the controller may apply an alternating current voltage between the flame sensing rod and the base of the flame (i.e. ground). The ions in the flame may provide a high resistance current path between the flame rod and the ground. Because the surface of the flame base is larger than the flame rod, more electrons may flow in one direction than the other, resulting in a relatively small direct current (DC) offset current. When a flame is present, this DC offset may be detected by the controller, which may indicate that a flame is present. The controller may then control the operation of the combustion system according to the presence of the flame. For example, when the flame is present, the controller may further open and/or leave open the gas valve and/or air flow dampers. If there is no flame present the controller may close the gas valve or take other action.

In many cases, the drive signal for the flame rod may need to be a relatively high-voltage AC signal, such as 100 Volts, 200 Volts or the like. However, in many cases, the control system may only have a relatively low voltage power source available, such as 24 Volts, 5 Volts or the like. As such, the control system may need to boost the low voltage into a high voltage source to generate the flame sensing signal. In some cases, to boost the relatively low voltage source, a DCDC step-up circuit may be used. In this case, the DCDC step-up circuit may be able to generate a high voltage DC power source, which may then be chopped to generate the desired high-voltage AC signal for the flame rod. However, this method can add significant cost to the control system. Therefore, there is a need for alternative control systems that can generate a relatively high voltage AC signal to drive a flame rod.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention relates generally to flame sensing circuits, and more particularly, to flame rod drive signal generators and systems. In one illustrative embodiment, a flame rod drive signal generator is provided for producing a flame rod drive signal for a flame rod of a combustion system. The flame rod drive signal generator may include a voltage source, an input signal having a frequency, an LC oscillator and a drive mechanism. The drive mechanism may be powered by the voltage source, and may have an output that is coupled to the LC oscillator. The drive mechanism may receive the input signal, and produces a current in the LC oscillator that has a frequency that is related to the frequency of the input signal. The LC oscillator may provide a flame rod drive signal that has an amplitude that is larger than the amplitude of the voltage source, and in some cases, significantly larger. A controller may monitor the amplitude of the flame rod drive signal and adjust the frequency of the input signal to achieve a desired amplitude of the flame rod drive signal. The controller may also monitor an ionization current produced by the flame rod when the flame rod is subject to a flame.

BRIEF DESCRIPTION

The invention may be more completely understood in consideration of the following detailed description of various illustrative embodiments of the invention in connection with the accompanying drawings, in which.

DETAILED DESCRIPTION

Figure 1:
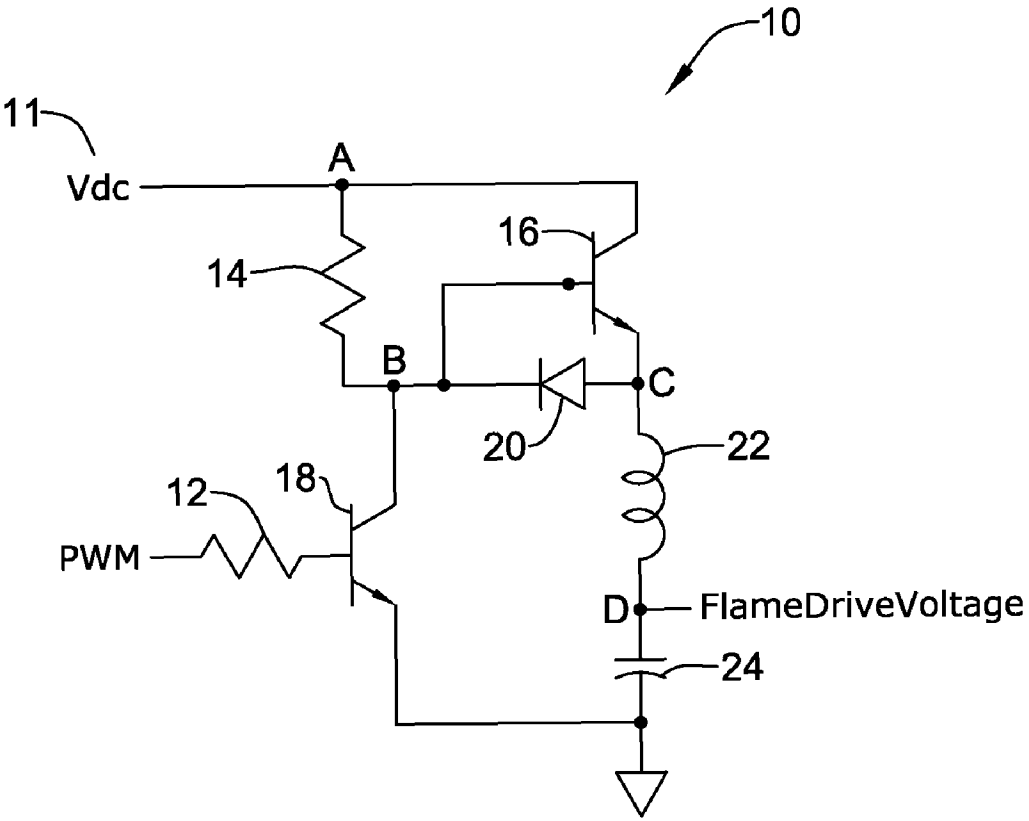
FIG. 1 is a schematic diagram of an illustrative flame rod drive signal circuit for a combustion system.

The following description should be read with reference to the drawings wherein like reference numerals indicate like elements throughout the several views. The detailed description and drawings show several embodiments, which are meant to be illustrative of the claimed invention.

FIG. 1 is a schematic diagram of an illustrative flame rod drive signal circuit 10 for a combustion system. In the illustrative embodiment, the flame rod drive signal circuit 10 includes a push-pull drive stage and an oscillation network. The push-pull drive stage may have an input and an output. The input of the push-pull drive stage may be connected to a voltage source 11, shown as Vdc, having a first voltage such as 24V, 5V or some other suitable voltage. The oscillation network may include an input and an output. The input of the oscillation network may be connected to the output of the push-pull drive stage and the output of the oscillation network may provide a flame rod drive signal, shown as FlameDrive-Voltage, having a second voltage. In some cases, the second voltage may be greater than the first voltage, and sometimes substantially greater such as 100V, 200V or any other suitable flame rod drive voltage. In some cases, a flame rod (shown as 54 in FIG. 7) may be connected to the output of the oscillation network to receive the flame rod drive signal.

Voltage source 11 may provide a first voltage to the flame rod drive signal circuit 10. In some cases, voltage source 11 may be provided as part of a building control system controller. In some cases, the building system controller may be a controller for a gas-fired building component. In the illustrative embodiment, voltage source 11 may be a direct current (DC) voltage source. In one example, voltage source 11 may be a rectified 24-volt AC signal. In the illustrative example, voltage source 11 may range from about 25 volts to 40 volts, as desired. However, it is contemplated that any suitable voltage source 11 may be used for the circuit, as desired.

In the illustrative embodiment, push-pull drive stage may include a pair of transistors 16 and 18, resistors 12 and 14, and a diode 20. Push-pull drive stage may include a first input, at node A, connected to the voltage source 11, and a second input, connected to a pulse width modulation (PWM) input signal. Push-pull drive stage may also include an output, designated as node C in FIG. 1.

In the illustrative embodiment, transistor 16 and 18 are shown as bipolar junction transistors (BJTs). However, it is contemplated that any suitable type of transistor or switching device may be used, such as field effect transistors (FETs). In the illustrative embodiment, transistors 16 and 18 are shown as NPN transistors. However, it is contemplated that transistors 16 and 18 may be PNP transistors, or a combination of NPN and PNP transistors, depending on the circuit configuration and design. In this configuration, as BJT transistors, transistors 16 and 18 may include a collector terminal, a base terminal, and an emitter terminal as shown.

Transistor 16 may be configured to have its collector terminal connected to node A, or the voltage source 11. Base terminal of transistor 16 may be connected to node B. Emitter terminal of transistor 16 may be connected to node C. Node B may be connected to node A via resistor 14. Node C may be connected to an anode terminal of diode 20 with the cathode connected to node B.

Transistor 18 may be configured to have its collector terminal connected to node B. Base terminal of transistor 18 may be connected to the PWM input signal via resistor 12, and emitter terminal of transistor 18 may be connected to ground as shown.

In the illustrative embodiment, the PWM input signal may be provided by a controller, such as, for example, a microcontroller or microprocessor. In the illustrative embodiment, the PWM signal may be a logic signal having a logic high state and a logic low state. In the logic high state, the PWM signal may be about 5 volts. In the logic low state, the PWM signal may be about 0 volts. When the PWM signal is logic high, transistor 18 may be turned on. When PWM signal is logic low, transistor 18 may be turned off.

In some cases, the controller may be able to control the PWM signal frequency and/or duty cycle. In some cases, as will be discussed below in further detail, the frequency and/or duty cycle of the PWM signal may control, at least in part, the amplitude of the flame rod drive output signal, provided at node D.

In one operational example, when the PWM signal is logic low, transistor 18 may be turned off. In this state, the voltage at the emitter of transistor 16, at node C, may be a positive voltage. In some cases, the voltage at node C may be about one or two diode drops below the first voltage provided by the voltage source 11. As such, current may flow through the load (i.e. LC oscillator including series connected inductor 22 and capacitor 24). In other words, in this state, current may be "pushed" through the load.

When the PWM signal is a logic high, transistor 18 may be turned on. In this state, the voltage at node C may be about 0 volts. As such, current may flow from the load to node C and through transistor 18. In other words, in this state, current may be "pulled" through the load. It is to be understood that the foregoing push-pull drive stage, that includes transistors 16 and 18, is merely illustrative and that any equivalent circuit or any similar type of circuit may be used, as desired.

The oscillation network load may include an input and an output. The input of the oscillation network may be connected to node C, or the output of the push-pull drive stage. The output of the oscillation network may be at node D, which may be correspond to the flame rod drive signal provided to the flame rod. In the illustrative embodiment, the oscillation network may amplify the voltage provided at the input of the oscillation network to a second voltage at the output of the oscillation network.

As illustrated, the oscillation network may include a LC oscillator that includes a series connected inductor 22 and capacitor 24. In the illustrative embodiment, inductor 22 is connected between node C and node D, and capacitor 24 is connected between node D and ground.

The oscillation network may have a resonant frequency. The resonant frequency may be based on the inductance of inductor 22 and the capacitance of capacitor 24, as indicated in the following equation:

$$f_r = \frac{1}{2\pi\sqrt{LC}}$$

In one example, the inductance of inductor 22 may be about 68 milliHenries (mH) and the capacitance of capacitor 24 may be about 4700 picofarads (pf). In this example, using the above equation, the resonant frequency may be about 8.9 kiloherts (kHz). However, this is merely illustrative and it is contemplated that any suitable inductance and capacitance may be used, depending on the desired resonant frequency for the circuit.

In operation, the oscillation network may amplify the voltage at node C according to the frequency and/or duty cycle of the PWM input signal provided by the controller. To determine the flame rod drive signal provided by the LC oscillator, the frequency of the PWM signal is needed. In one example, the frequency of the PWM signal may be about 8.33 kilohertz (kHz), which is less than the resonant frequency of the oscillation network. In some cases, having the frequency of the PWM signal to be offset from the resonant frequency of the oscillation network may be desirable, but it is not required. Knowing the frequency of the PWM signal, the angular frequency ($\omega$) may be determined according to the following equation:

$$\omega=2\pi f$$

In the illustrative example, with a frequency of about 8.33 kHz, the angular frequency $\omega$ is about 52 Kilo-Radians/Second.

Next, to determine the amplitude of the flame rod drive signal, the inductance reactance ($X_L$) and capacitance reactance ($X_C$) may be determined. The inductance reactance and capacitance reactance may be determined according to the following equations:

$$X_L = \omega L$$

-continued $$X_C = \frac{1}{\omega C}$$

where L is the inductance of inductor 22 and C is the capacitance of capacitor 24. In the illustrative example, with an inductance of 68 mH and a capacitance of 4700 pf, $X_L$ is about 3.5 kΩ and $X_C$ is about 4 kΩ.

To illustrate the basic calculation, and neglecting parasitic parameters such as the series resistance of the inductor, the core loss of the inductor, the leakage resistance of the capacitor, etc. (which may or may not be neglected in practice, depending on the application), the impedance (Z) of the LC oscillator may be calculated according to the following equation:

$$Z=|X_L-X_C|$$

Using the illustrative inductance and capacitance values, Z may be about 500 ohms.

Next, the current (i) flowing through the inductor 22 and capacitor 24 may be determined using the source voltage (v) of the circuit in the following equation:

$$i = \frac{v}{Z}$$

In one cases, the illustrative source voltage (i.e. voltage at node C) may be about 25 volts. Using this illustrative voltage and the illustrative impedances, the current i may be about 49.7 milliamps (mA).

Then, with the example current, the inductor voltage ($V_L$) and the capacitor voltage ($V_C$) may be determined according to the following equations:

$$V_L=iX_L$$

$$V_C=iX_C$$

In the given example, $V_L$ may be about 177 volts and $V_C$ may be about 202 volts. Thus, the voltage at node D, or $V_C$ in this case, is 202 Volts.

In the illustrative embodiment, increasing the illustrative source voltage (i.e. voltage at node C) may increase the flame rod drive signal output voltage. Additionally, as will be discussed in FIG. 3, increasing the frequency closer to the resonant frequency may increase the voltage at the flame rod drive signal output. In some cases, the illustrative embodiment may generate a relatively high flame rod drive signal voltage, such as, for example, between 50 volts and 400 volts, and may be an alternating current (AC) signal which is ideal for driving a flame rod.

In one illustrative example, resistor 12 may be about 3.3 kΩ and resistor 14 may be about 10 kΩ. However, it is contemplated that any suitable resistance may be used for resistors 12 and 14, as desired.

In some cases, transistors 16 and 18 may be configured to withstand only the relatively low voltage level of voltage source 11 instead of the relatively high voltage levels of the flame rod drive output signal. This may reduce the cost of the overall system. Additionally, in some embodiments, transistors 16 and 18 may be operated in the off or saturated stated. In this case, the power consumption of the transistors 16 and 18 may be relatively low. In some cases, and due to the relatively high voltage of the oscillation network, it may be desirable to have relatively high voltage components in the oscillation network. For example, capacitor 24 may be a film capacitor rated at 160 VAC or higher.

Figure 2:
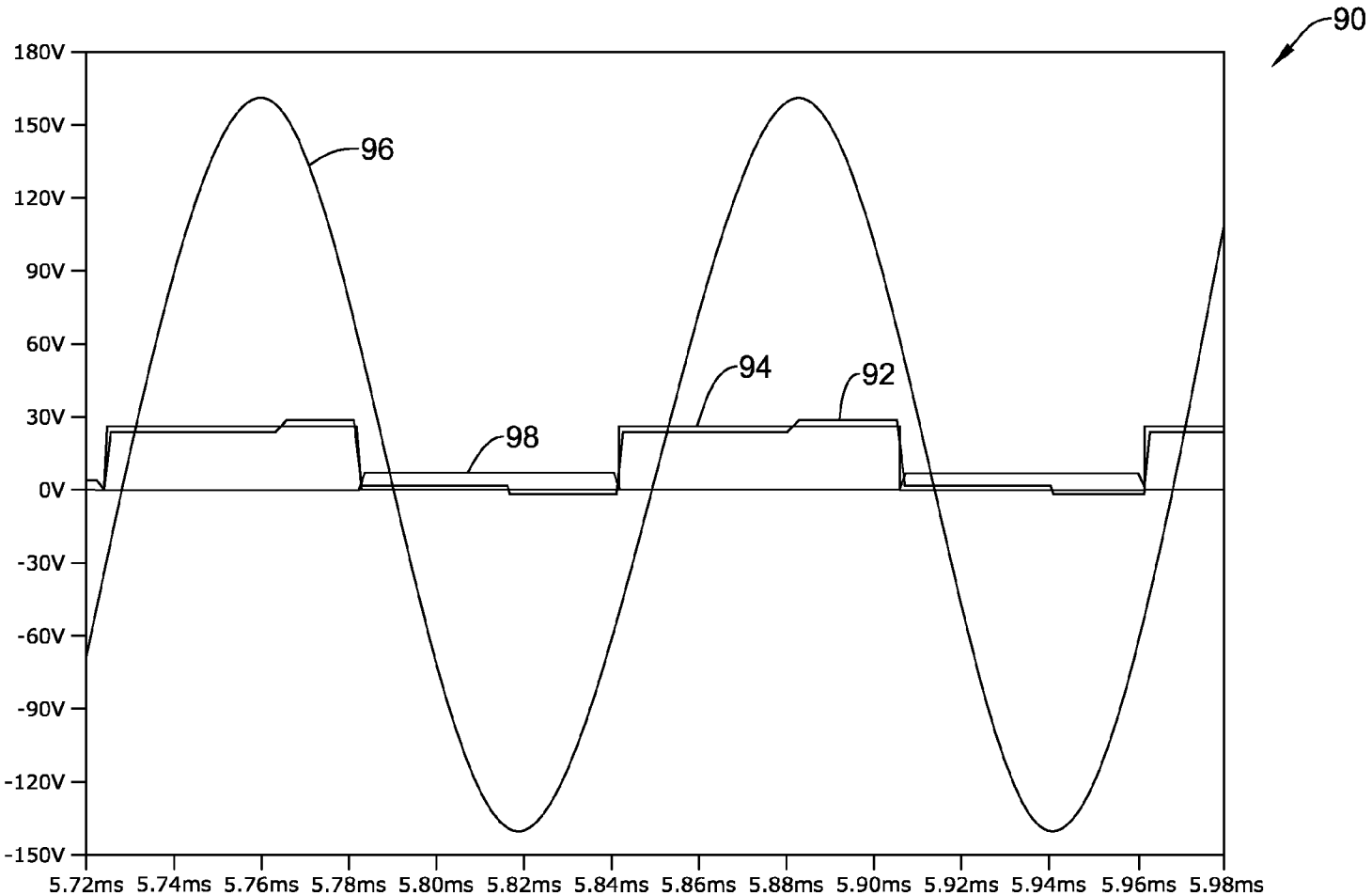
FIG. 2 is an illustrative graph showing waveforms for the illustrative flame rod drive signal circuit of FIG. 1.

FIG. 2 is an illustrative graph 90 showing waveforms of the illustrative flame rod drive signal circuit 10 of FIG. 1. The illustrative graph shows waveforms of the voltage over a period of time at the emitter of transistor 16 (node C) 92, at the collector of transistor 18 (node B) 94, at the flame rod drive voltage output signal (node D) 96, and at the PWM input signal from the controller 98.

As illustrated in the waveforms, the voltage of waveform 92 at the emitter of transistor 16 and waveform 94 of the collector of transistor 18 may be similar. In some cases, the illustrative voltages may be about one diode drop apart. Additionally, these voltages may be about one or two diode drops below the voltage source 11 (not shown) when transistor 18 is turned off.

The illustrative PWM waveform 98 may alternate between a logic high state (about 5 volts) and a logic low state (about 0 volts). As discussed previously, when the PWM waveform 98 is logic low, the voltage at the emitter of transistor 16 and the collector of transistor 18 may be relatively high, which, in the illustrative case, may be about 25 volts. However, the voltage of waveforms 92 and 94 may be dependant upon the PWM signal that is provided to the flame rod drive signal circuit. When the PWM signal is logic high, the voltage at the emitter of transistor 16 and the collector of transistor 18 may be relatively low, which, in the illustrative case, may be about 0 volts.

In the illustrative embodiment, with the example inductance, capacitance, and frequency, the flame rod drive signal waveform 96 may be a generally sinusoidal signal having a relatively large amplitude. In the illustrative embodiment, the voltage may range from about −185 volts to about 180 volts. However, the illustrated flame rod drive signal waveform 96 is merely illustrative and it is contemplated that any suitable flame rod drive signal may be used, as desired.

Figure 3:
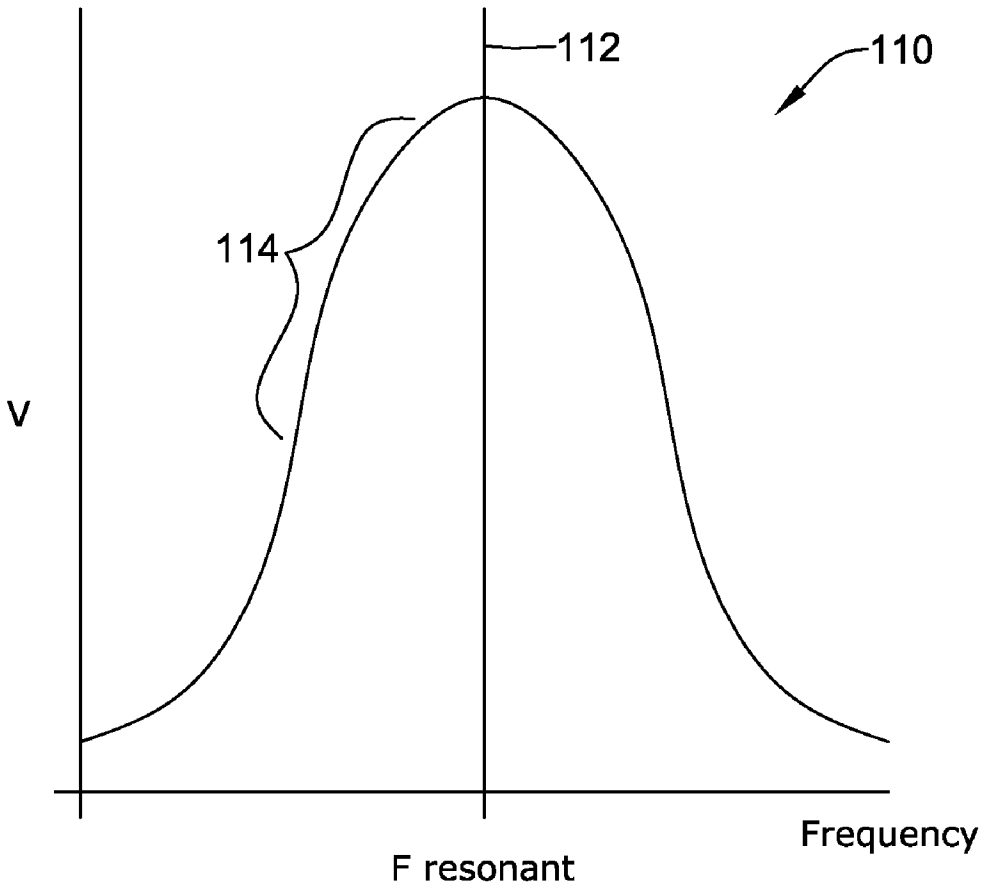
FIG. 3 is an illustrative graph of voltage versus frequency for the flame rod drive signal circuit of FIG. 1.

FIG. 3 is an illustrative graph 110 of voltage versus frequency for the flame rod drive signal circuit of FIG. 1. In the illustrative graph 110, the resonant frequency, shown at 112, may be the frequency at which the flame rod drive signal waveform 96 peaks. From the illustrative example above, the resonant frequency may be about 8.9 kilohertz. However, any suitable resonant frequency may be used, depending on the inductance and capacitance values of the oscillation network, as desired.

As discussed previously, the voltage provided by the flame rod drive signal may be determined by the sum of $X_C$ and $X_L$. To the right of the resonant frequency, or at a frequency greater than the resonant frequency, $X_L$ may be greater than $X_C$. To the left of the peak, or at a frequency less than the resonant frequency, $X_C$ may be greater than $X_L$. By varying the PWM frequency along this curve, the voltage produced by the LC oscillator may be increased or decreased to a desire value.

In the illustrative embodiment, parasitic capacitance may be present in the flame rod drive signal circuit. To help reduce the effect of any parasitic capacitance, it may be desirable to operate at a frequency lower than the resonant frequency, such as in a region designated by reference numeral 114. The effect of the parasitic capacitance may be reduced because, as stated above, $X_C$ increases as the frequency decreases. As such, at lower frequencies, the effect of parasitic capacitance will make up a smaller percentage of the overall capacitance value, in essence, reducing the parasitic capacitance effect when the frequency is reduced.

Figure 4:
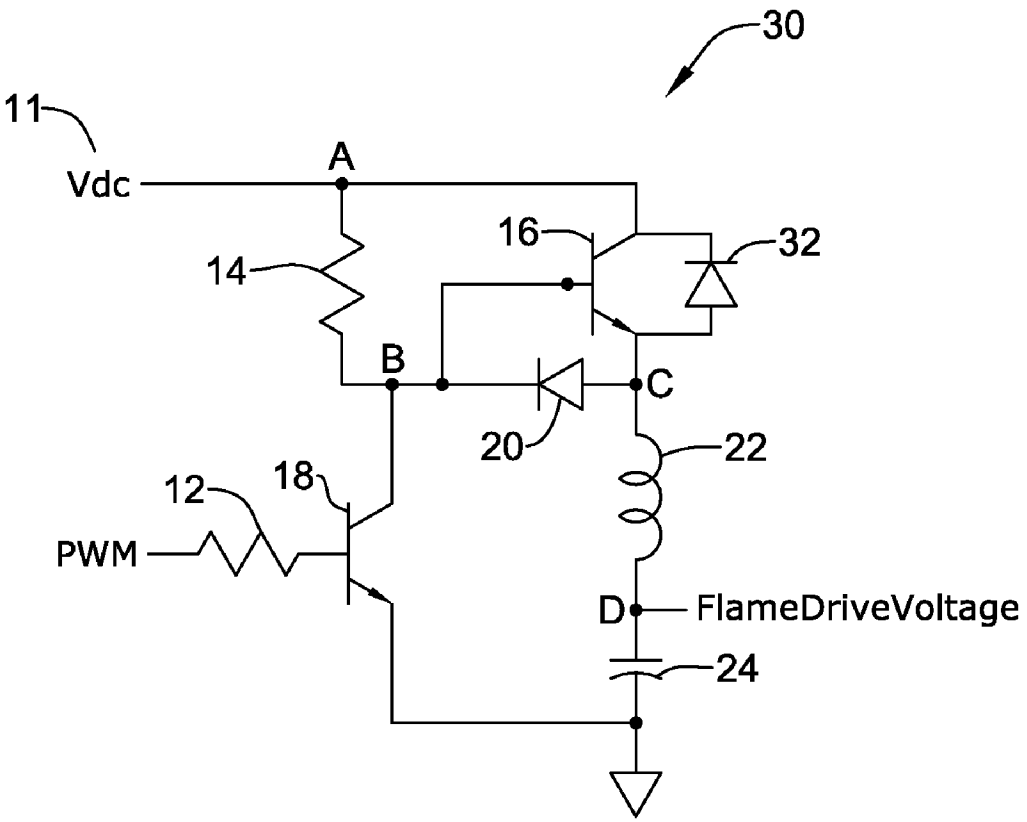
FIG. 4 is a schematic diagram of another illustrative flame rod drive signal circuit.

FIG. 4 is a schematic diagram of another illustrative flame rod drive signal circuit 30. The illustrative flame rod drive signal circuit 30 is similar to the flame rod drive signal circuit described above with reference to FIG. 1, with the addition of diode 32. With the circuit shown in FIG. 1, when the PWM frequency is lower than the resonant frequency, transistor 16 may be reversely biased for some time in each cycle, allowing current flow from node C to Vdc. While a BJT can work in this condition, adding diode 32 to provide a current path, may improve the overall efficiency of the drive circuit. If a MOSFET is used as 16, then the diode 32 may not help in this regard. As illustrated, diode 32 may have an anode connected to the emitter of transistor 16 and a cathode connected to the collector of transistor 16.

Figure 5:
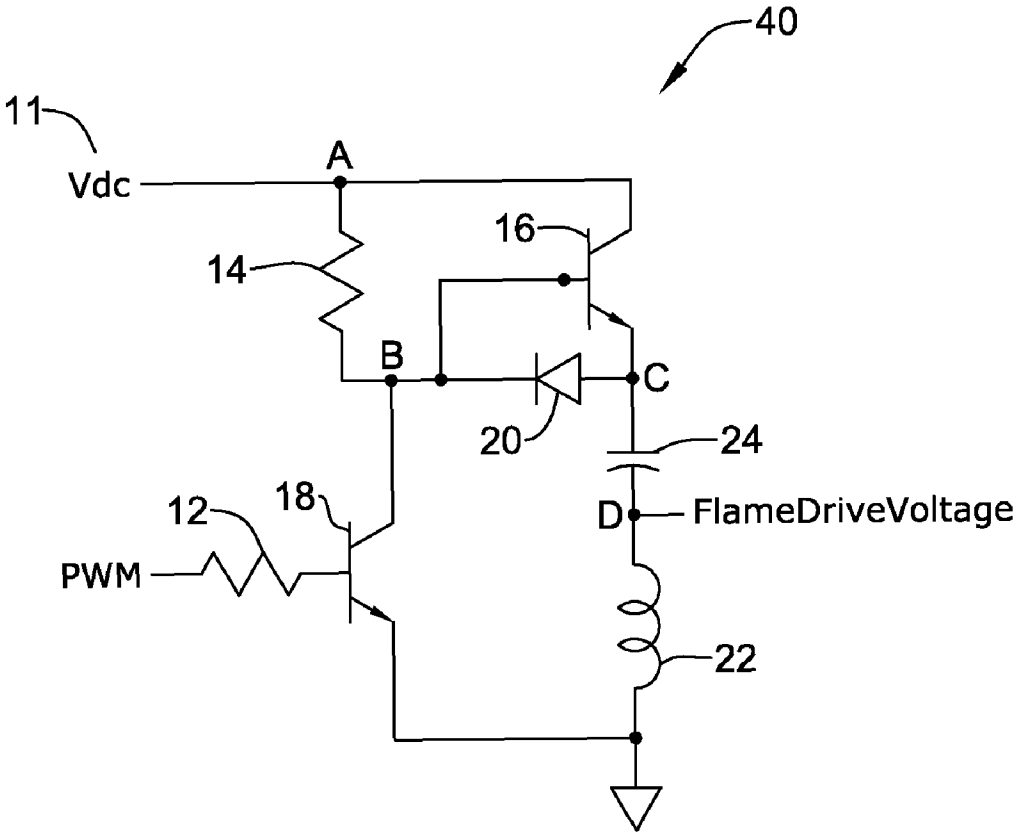
FIG. 5 is a schematic diagram of another illustrative flame rod drive signal circuit.
Figure 6:
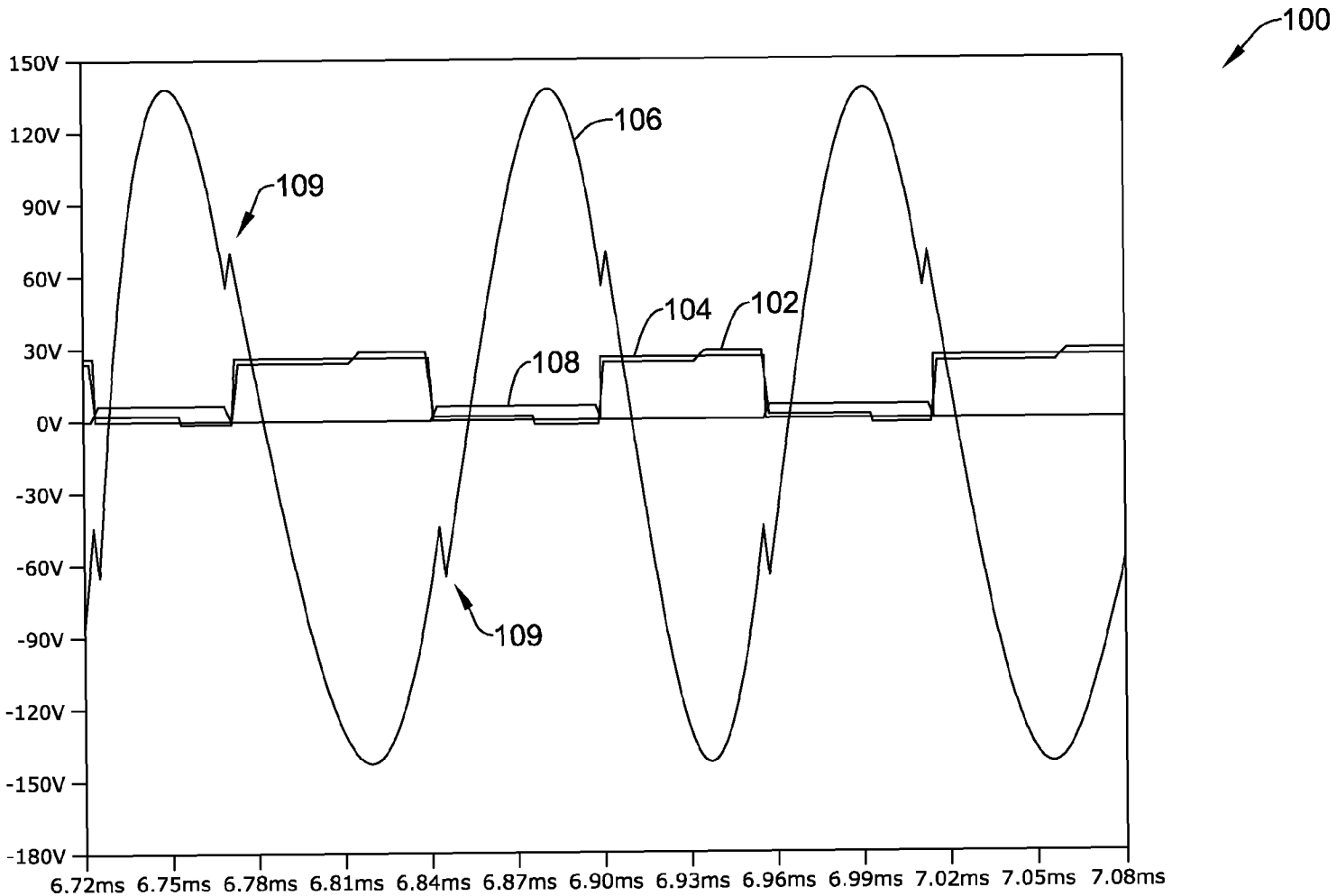
FIG. 6 is an illustrative graph showing waveforms of the illustrative flame rod drive signal circuit of FIG. 5.

FIG. 5 is a schematic diagram of another illustrative flame rod drive signal circuit 40. The illustrative flame rod drive signal circuit 40 may be similar to that described above with reference to FIG. 1, with the modification of swapping the position of inductor 22 and capacitor 24. In the illustrative embodiment, inductor 22 may be grounded, whereas in FIG. 1, capacitor 24 was grounded. In the illustrative embodiment, the swapping of inductor 22 and capacitor 24 may produce a waveform with sharper rising and falling edges, as shown in FIG. 6. Additionally, the phase of the flame rod drive output signal may be 180 degrees offset relative to the flame rod drive output signal of the embodiment of FIG. 1. If desired, diode 32 may be added to flame rod drive signal circuit 40, similar to FIG. 4.

FIG. 6 is an illustrative graph 100 showing waveforms of the flame rod drive signal circuit of FIG. 5. The illustrative graph 100 shows waveforms of the voltage over a period of time at the emitter of transistor 16 (node C) 102, the collector of transistor 18 (node B) 104, the flame rod drive voltage output signal (node D) 108, and the PWM input signal from the microcontroller 106.

As illustrated in the waveforms, the voltage of waveform 102 at the emitter of transistor 16 and waveform 104 of the collector of transistor 18 may be similar. In some cases, the illustrative voltages may be about one diode drop apart. Additionally, these voltages may be about one or two diode drops below the voltage source 11 (not shown), when the transistor 18 is turned off.

The illustrative PWM waveform 98 may alternate between a logic high state (about 5 volts) and a logic low state (about 0 volts). As discussed previously, when the PWM waveform 108 is at a logic low, the voltage at the emitter of transistor 16 and the collector of transistor 18 may be relatively high, which, in the illustrative case, may be about 25 volts. When the PWM signal is at a logic high, the voltage at the emitter of transistor 16 and the collector of transistor 18 may be relatively low, which, in the illustrative case, may be about 0 volts.

In the illustrative embodiment, the flame rod drive signal waveform 106 may be a generally sinusoidal signal having a relatively large amplitude. In the illustrative case, the voltage may range from about −160 volts to about 160 volts. However, the illustrated flame rod drive signal waveform 106 is merely illustrative and it is contemplated that any suitable flame rod drive signal may be used, as desired. In the illustrative embodiment, waveform 106 may include one or more spikes 109 when the PWM waveform switches between the logic high and logic low states.

Figure 7:
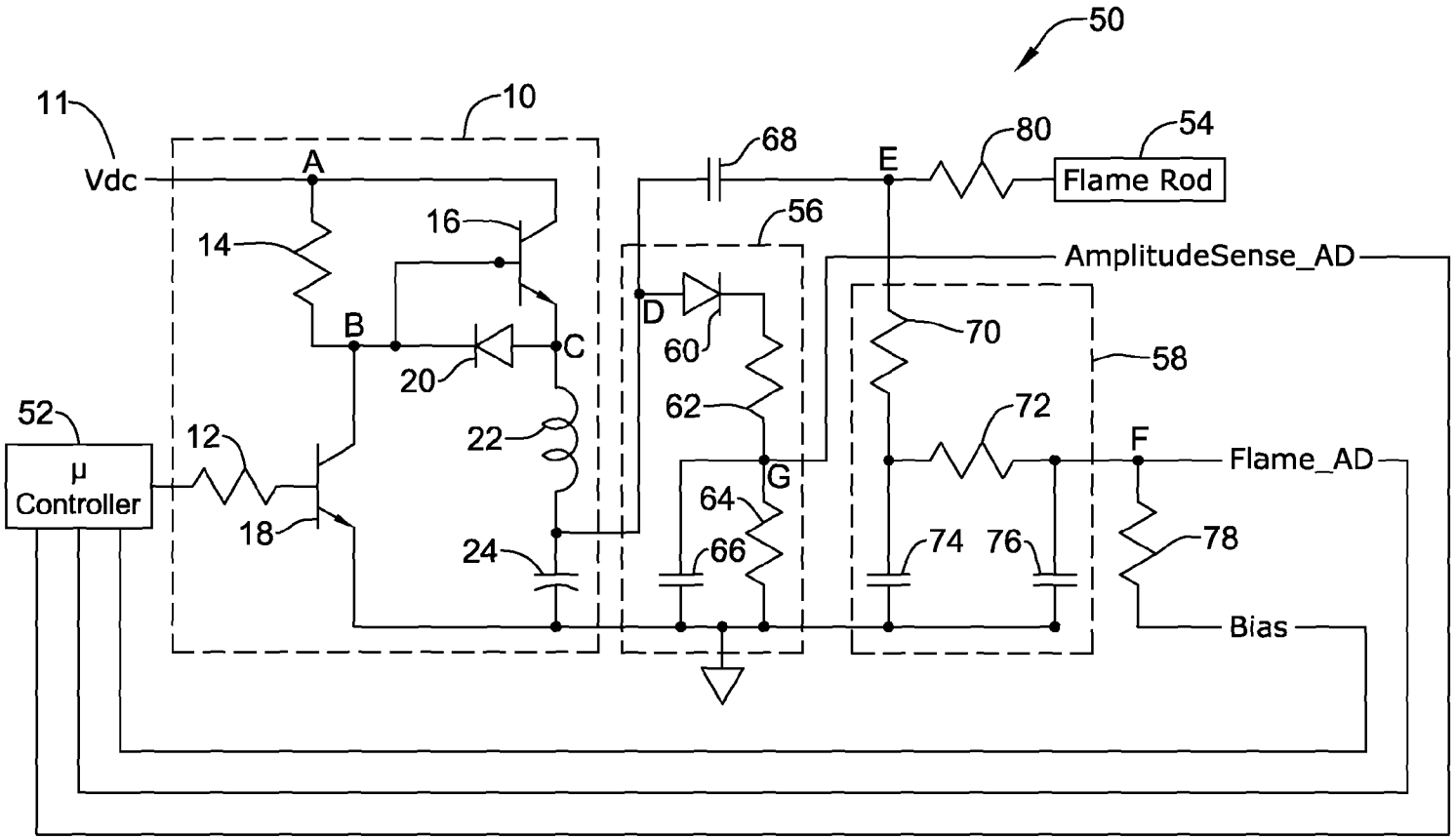
FIG. 7 is a schematic diagram of an illustrative flame sensing circuit.

FIG. 7 is a schematic diagram of an illustrative flame sensing circuit 50. In the illustrative embodiment, the flame sensing circuit 50 may include a flame rod drive signal circuit 10 (see FIG. 1) having a flame rod drive signal output (node D). As illustrated, the illustrative flame sensing circuit 50 may also include a voltage sensing network 56, a ripple filter 58, and/or a bias element 78. In FIG. 7, the flame rod drive signal circuit 10 is shown as the flame rod drive signal circuit of FIG. 1, however, it is contemplated that the embodiments of FIGS. 4 and/or 5 may be used, if desired.

In the illustrative embodiment, flame sensing circuit 50 may be connected to a flame rod 54. Flame rod 54 may be provided in or adjacent to a flame in a combustion system to detect the presence of a flame on a burner in the combustion system. When a flame is present, the flame rod may have a corresponding DC offset current. When no flame is present, the flame rod may have no or little DC offset current. It is contemplated that any suitable flame rod may be used, as desired.

In the illustrative embodiment, a microcontroller 52 may be connected to the circuit 50 to provide one or more inputs to the circuit 50 and/or receive one or more outputs from the circuit 50. In the illustrative embodiment, the microcontroller 52 may have a first output to provide a PWM input signal to the flame rod drive signal circuit 10 to switch transistor 16 on and off, as discussed above. Microcontroller 52 may also have a second output connected to the flame sensing circuit 50 to provide a bias input to bias element 78, if desired. Microcontroller 52 may have a first input to receive an Amplitude-Sense_AD output signal indicating the amplitude of the flame rod drive signal provided to the flame rod 54. Microcontroller 52 may also have a second output connected to the flame sensing circuit 50 to receive a Flame_AD signal indicating the presence of the flame in the combustion system. In some cases, microcontroller 52 may use the two received signal to adjust the frequency and/or duty cycle of the PWM to achieve a desired flame rod drive signal amplitude, and/or to adjust the voltage of the bias signal.

Voltage sensing network 56 may be able to sense the amplitude of the flame rod drive signal provided to the flame rod 54. In the illustrative embodiment, voltage sensing network 56 may have an input connected to node D, which is at the output of the flame rod drive signal circuit 10, and an output (node G) connected to the first input of the microcontroller 52. The voltage sensing network 56 may provide an output signal to the microcontroller 52 indicative of the amplitude of the flame rod drive signal. In response, and in some cases, microcontroller 52 may adjust the frequency and/or duty cycle of the PWM to adjust the amplitude of the flame rod drive signal on node D.

In the illustrative embodiment, the voltage sensing network 56 may include a voltage divider. As illustrated, the voltage divider may include resistors 62 and 64. In some cases, a diode 60 may be provided to help prevent current backflow, and a capacitor 66 may be provided to help filter the output. In the illustrative example, anode of diode 60 may be connected to node D and cathode of diode may be connected to resistor 62, which may be connected to node G as shown. Resistor 64 may be connected between node G and ground. Capacitor 66 may be connected between node G and ground. Node G may be connected to the microcontroller 52 as the output of the voltage sensing network 56. In this configuration, microcontroller 52 may be able to sense the voltage across resistor 64, indicating the amplitude of the flame rod drive signal.

In one example, resistor 62 may be about 470 kΩ, resistor 64 may be about 30 kΩ, and capacitor 66 may be about 0.22 microfarads. However, it is contemplated that any suitable resistance and/or capacitance values may be used, as desired. In some cases, the voltage across the voltage sensing network may be relatively large. In this case, the resistor 62 and capacitor 66 may be high voltage components. However, any suitable components may be used, as desired.

Ripple filter 58 may be configured to filter and sense the DC offset current of the flame rod 54. In the illustrative embodiment, ripple filter 58 may include an input connected to node E and an output connected to node F, which may be connected to the second input of microcontroller 52. In the illustrative example, the ripple filter 58 may be a 2-pole low-pass filter that may be able to filter out the AC component of the flame rod drive signal. In the illustrative example, the 2-pole low-pass filter may include resistors 70 and 72 and capacitors 74 and 76. Resistor 70 and capacitor 74 may form a first low pass filter and resistor 72 and capacitor 76 may form a second low pass filter. In one example, resistors 70 and 72 may be about 470 kΩ, and capacitors 74 and 76 may be about 22 nanofarads. However, it is contemplated that any suitable resistances and capacitances may be used, as desired.

In addition, and in some cases, the second pole of the ripple filter 58 including resistor 72 and capacitor 76 may be removed depending on if the microcontroller 52 has enough processing power to perform a comparable filtering function. For example, and during operation, microcontroller 52 may be able to sense the flame signal (node F) in synchronization with the flame rod drive signal (node D) and remove the ripple to get the flame current signal. In some cases, microcontroller may use the amplitude and other properties of the AC component of the ripple to diagnose the flame sensing circuit 50 and check the condition of the parts or portions of the flame sensing circuit 50.

In some cases, with the circuit parts or portions in good working condition, the AC component amplitude may be estimated or measured. These amplitude data may be stored in a non-volatile memory of the controller. During normal operation, the AC component may be monitored. If the AC component becomes too high or too low compared to the stored value, an error message may be reported. The AC component amplitude may be used to help identify the possible faulty part or portion of the circuit. For example, many diagnostics uses are described in U.S. application Ser. No. 11/276,129, entitled CIRCUIT DIAGNOSTICS FROM FLAME SENSING AC COMPONENT, which is incorporated herein by reference.

In some cases, a bias element 78 and bias signal may be provided to adjust the flame sensing signal to a suitable voltage level for the microcontroller 52 to sense. For example, and in some cases, the bias element 78 may be connected to the second output of microcontroller 52. In such a case, resistor 78 may be the bias element, and may be about 200 kΩ, however, any suitable resistance may be used, as desired.

The bias signal can be a voltage, such as a DC voltage, or a PWM signal provided by the microcontroller 52. In some cases, if the bias signal is a PWM signal, the bias may be changed to increase the flame sensing dynamic range, and DC leakage may be detected and compensated to improve flame sensing accuracy and robustness, such as described in U.S. application Ser. No. 10/908,463, entitled DYNAMIC DC BIASING AND LEAKAGE COMPENSATION, which is incorporated herein by reference.

In some cases, flame sensing circuit 50 may include a decoupling capacitor 68. The decoupling capacitor 68 may help reduce or eliminate DC coupling in the circuit 50. In one example, the decoupling capacitor 68 may have a capacitance of about 4700 pf However, any suitable capacitance may be used, as desired.

In the illustrative embodiment, a resistor 80 may be provided in series with the flame rod 54 for safety. In some cases, resistor 80 may be provided to limit the current in case a human being touches the rod while it carries a high AC voltage. In one case, the resistance of resistor 80 may be about 200 kΩ. However, any suitable resistance may be used, as desired. In some cases, resistor 80 may not be provided.

In some cases, the flame rod drive signal voltage (node D) may be changed to increase the dynamic range of the flame sensing circuit 50, such as described in U.S. application Ser. No. 10/908,467, entitled ADAPTIVE SPARK IGNITION AND FLAME SENSING SIGNAL GENERATION SYSTEM, which is incorporated herein by reference.

The control algorithm may be similar to that of the flame sensing methods described in U.S. application Ser. No. 10/908,465, entitled LEAKAGE DETECTION AND COMPENSATION SYSTEM; U.S. application Ser. No. 11/276,129, entitled CIRCUIT DIAGNOSTICS FROM FLAME SENSING AC COMPONENT; U.S. application Ser. No. 10/908,467, entitled ADAPTIVE SPARK IGNITION AND FLAME SENSING SIGNAL GENERATION SYSTEM; and U.S. application Ser. No. 10/908,463, entitled DYNAMIC DC BIASING AND LEAKAGE COMPENSATION, which are incorporated herein by reference.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A flame rod drive signal generator for producing a flame rod drive signal for a flame rod of a combustion system, the flame rod drive signal generator comprising:

a voltage source having an amplitude;

an input signal having a frequency;

an LC oscillator having a resonant frequency;

a drive mechanism, wherein the drive mechanism is powered by the voltage source, and has an output that is coupled to the LC oscillator, the drive mechanism receiving the input signal, and producing a current in the LC oscillator that has a frequency that is related to the frequency of the input signal; and a flame rod drive output coupled to the LC oscillator for providing a flame rod drive signal that has an amplitude that is larger than the amplitude of the voltage source.

2. The flame rod drive generator of claim 1 wherein the frequency of the input signal can be varied relative to the resonant frequency of the LC oscillator to vary the amplitude of the flame rod drive signal provided at the flame rod drive output.

3. The flame rod drive generator of claim 2 further comprising a voltage sensor for sensing the amplitude of the flame rod drive signal.

4. The flame rod drive generator of claim 3 further comprising a controller coupled to the voltage sensor and providing the input signal to the drive mechanism, wherein the frequency of the input signal provided by the controller is dependent upon the sensed amplitude of the flame rod drive signal sensed by the voltage sensor.

5. The flame rod drive generator of claim 4 further comprising a filter coupled to the flame rod for providing a signal that is related to an ionization current produced by the flame rod.

6. A flame rod drive signal circuit for producing a flame rod drive signal for a flame rod of a combustion system, the flame rod drive signal circuit comprising:

a push-pull drive stage including an input and an output, the input connected to a voltage supply having a first voltage, the push-pull drive stage including a first transistor and a second transistor; and an oscillation network including an input and an output, the input of the oscillation network connected to the output of the push-pull drive stage, and the output of the oscillation network adapted to be coupled to the flame rod, the oscillation network including an inductor and a capacitor configured to provide a flame rod drive signal at the output of the oscillation network at a second voltage, wherein the second voltage is greater than the first voltage.

7. The flame rod drive signal circuit of claim 6 wherein an amplitude of the second voltage is dependent upon a frequency within the oscillation network.

8. The flame rod drive signal circuit of claim 7 wherein the frequency of the oscillation network is controlled, at least in part, by a pulse width modulation (PWM) signal.

9. The flame rod drive signal circuit of claim 8 wherein the PWM signal is provided by a controller.

10. The flame rod drive signal circuit of claim 9 wherein the controller monitors an amplitude of the flame rod drive signal, and adjust the PWM signal to increase and/or decrease the amplitude of the flame rod drive signal.

11. The flame rod drive signal circuit of claim 7 wherein the oscillation network is operated at a frequency less than a resonant frequency of the oscillation network.

12. The flame rod drive signal circuit of claim 11 wherein the resonant frequency is between 7 and 11 kilohertz.

13. The flame rod drive signal circuit of claim 7 wherein the first voltage is in the range of 10 to 40 volts.

14. The flame rod drive signal circuit of claim 13 wherein the second voltage is in the range of 60 to 300 volts AC.

15. A flame sensing system comprising:

a push-pull drive stage including an input and an output, the input connected to a voltage supply having a first voltage, the push-pull drive stage including a first transistor and a second transistor;

an oscillation network including an input and an output, the input of the oscillation network connected to the output of the push-pull drive stage, the oscillation network including an inductor and a capacitor configured in series to provide a flame rod drive signal having a second voltage, wherein the second voltage is greater than the first voltage;

a flame rod connected to the output of the oscillation network to receive the flame rod drive signal; and a microcontroller connected to the second transistor of the push-pull drive stage, the microcontroller providing a pulse width modulation (PWM) signal to drive the oscillation network at a frequency and a duty cycle, wherein the microcontroller monitors an amplitude of the flame rod drive signal and adjust the frequency, the duty cycle, or both, of the PWM signal to increase and/or decrease the amplitude of the flame rod drive signal.

16. The flame sensing system of claim 15 further comprising a voltage sensing circuit configured to sense the amplitude of the flame rod drive signal.

17. The flame sensing system of claim 16 wherein the voltage sensing circuit includes a voltage divider having an output connected to an input of the microcontroller.

18. The flame sensing system of claim 15 further comprising a ripple filter having an input connected to the flame rod drive signal and an output connected to the microcontroller, wherein the microcontroller senses an ionization signal provided by the flame rod when subject to a flame.

19. The flame sensing system of claim 18 wherein the ripple filter includes a low-pass filter to filter out an AC component of the flame rod drive signal.

20. The flame sensing system of claim 19 wherein the microcontroller detects a DC component produced by the flame rod when the flame rod is subject to a flame.

* * * * *